United States Patent [19]

Kalina

[11] Patent Number: 4,586,340

[45] Date of Patent: May 6, 1986

[54] METHOD AND APPARATUS FOR IMPLEMENTING A THERMODYNAMIC CYCLE USING A FLUID OF CHANGING CONCENTRATION

[76] Inventor: Alexander I. Kalina, 12214 Clear Fork, Houston, Tex. 77077

[21] Appl. No.: 693,470

[22] Filed: Jan. 22, 1985

[51] Int. Cl.[4] ..... F01K 25/06

[52] U.S. Cl. ..... 60/673; 60/649; 60/677

[58] Field of Search ..... 60/649, 673, 677

[56] References Cited

U.S. PATENT DOCUMENTS 4,534,175 8/1985 Kogan et al. ..... 60/649

*Primary Examiner*—Allen M. Ostrager

*Attorney, Agent, or Firm*—Arnold, White & Durkee

[57] ABSTRACT

A method and apparatus for implementing a thermodynamic cycle involves utilizing partial distillation of a multi-component working fluid stream. At least one main enriched solution is produced which is relatively enriched with respect to the lower boiling temperature component, together with at least one lean solution which is relatively impoverished with the respect of lower boiling temperature component. The main working fluid is expanded to a low pressure level to convert energy to a usable form. This spent low pressure level working fluid is condensed by dissolving with cooling in the lean solution to regenerate an initial working fluid for reuse. A portion of the impoverished fraction may be injected into the charged gaseous main working fluid in order to obtain added work and to increase system efficiency by decreasing the temperature of the output fluid flow when the fluid flow would otherwise have been superheated. A low pressure, low temperature expanded spent fluid may be distilled using low quality heat to create an enriched solution which has a significantly higher concentration of the lower boiling component. For this enriched solution, a reduced temperature and pressure is sufficient to enable distillation. The efficiency of the cycle may be enhanced by charging the spent fluid with the lower boiling temperature component prior to distillation. This may be accomplished by lowering the pressure of the impoverished fraction to separate an additional lower boiling temperature fraction.

23 Claims, 1 Drawing Figure

METHOD AND APPARATUS FOR IMPLEMENTING A THERMODYNAMIC CYCLE USING A FLUID OF CHANGING CONCENTRATION

BACKGROUND OF THE INVENTION

1. Field of the Invention

This invention relates generally to methods and apparatus for transforming energy from a heat source into usable form using a working fluid that is expanded and regenerated. This invention further relates to a method and apparatus for improving the heat utilization efficiency of a thermodynamic cycle.

2. Brief Description of the Background Art

In the Rankine cycle, the working fluid such as water, ammonia or a freon is evaporated in an evaporator utilizing an available heat source. The evaporated gaseous working fluid is expanded across a turbine to transform its energy into usable form. The spent gaseous working fluid is then condensed in a condenser using an available cooling medium. The pressure of the condensed working medium is increased by pumping, followed by evaporation, and so on to continue the cycle.

The basic Kalina cycle, described in U.S. Pat. No. 4,346,561, utilizes a binary or multi-component working fluid. This cycle operates generally on the principle that a binary working fluid is pumped as a liquid to a high working pressure and is heated to partially vaporize the working fluid. The fluid is then flashed to separate high and low boiling working fluids and the low boiling component is expanded through a turbine to drive the turbine, while the high boiling component has heat recovered for use in heating the binary working fluid prior to evaporation. The high boiling component is then mixed with the spent low boiling working fluid to absorb the spent working fluid in a condenser in the presence of a cooling medium.

A theoretical comparison of the conventional Rankine cycle and the Kalina cycle demonstrates the improved efficiency of the new cycle over the Rankine cycle when an available, relatively low temperature heat source such as ocean water, geothermal energy or the like is employed.

In applicant's further invention, referred to as the Exergy cycle, the subject of U.S. patent application Ser. No. 405,942, filed Aug. 6, 1982, now U.S. Pat. No. 4,489,563 relatively lower temperature avilable heat is utilized to effect partial distillation of at least a portion of a multicomponent working fluid stream at an intermediate pressure to generate working fluid fractions of differing compositions. The fractions are used to produce at least one main rich solution which is relatively enriched with respect to the lower boiling component, and to produce at least one lean solution which is relatively impoverished with respect to the lower boiling component. The pressure of the main rich solution is increased; thereafter, it is evaporated to produce a charged gaseous main working fluid. The main working fluid is expanded to a low pressure level to convert energy to usable form. The spent low pressure level working fluid is condensed in a main absorption stage by dissolving with cooling in the lean solution to regenerate an initial working fluid for reuse.

The inventor of the present invention has appreciated that it would be highly desirable to enable the efficient use of a very low pressure and temperature fluid at the turbine outlet, in the Exergy cycle. Regardless of the temperature of the cooling water in the condenser, the higher the pressure of condensation in the Exergy cycle, the higher is the concentration of the lower boiling component in the basic solution. However, the higher the pressure of condensation, the higher the pressure at the turbine outlet and the higher the concentration of the lower boiling component at the turbine outlet. This higher concentration basic solution requires for distillation, heat of a lower temperature. Thus, by reducing the pressure, and consequently the temperature at the turbine outlet, the concentration of the lower boiling component of the basic solution may be lowered and a higher temperature may be required at the turbine outlet to provide for distillation.

This contradiction might be addressed by balancing the pressure at the turbine outlet with the cooling water temperature. However, to achieve the maximum power output, the turbine outlet pressure must be as low as possible. When the turbine outlet pressure and temperature are reduced, as described above, the concentration of the lower boiling component of the basic solution decreases. This results in a cycle requiring exactly the opposite action to increase the turbine outlet pressure and temperature. The situation worsens with higher available cooling water temperature.

The inventor of the present invention has also appreciated the desirability of controlling the outlet temperature of the fluid exiting the turbine in the Exergy cycle. The efficiency of a thermodynamic cycle such as the Exergy cycle may be improved by heating the fluid in the boiler to the highest possible temperature with the available heat source. However, it is still desirable that the fluid exiting from the turbine be at a temperature and pressure close to that of a saturated vapor. To the extent that the exiting vapor is superheated, exergy is wasted.

It is particularly desirable in the Exergy cycle to obtain only slightly superheated vapor or saturated vapor from the turbine while inputting fluid at the highest possible temperature to the turbine. This is because in the Exergy cycle the output from the turbine is not simply condensed, but instead is used for distillation. The superheating of the fluid outletted from the turbine may cause unnecessary exergy losses in the cycle as a whole. For example, since the spent fluid from the turbine may be used to pre-heat the condensed fluid in a heat exchanger prior to regeneration, as described in the aforementioned patent application, an inefficiently high temperature difference may exist in the heat exchanger.

If one attempts to overcome this problem by further fluid expansion in the turbine, one obtains a lower temperature at the turbine outlet but a lower pressure as well. This lower pressure fluid is more troublesome to distill because more heat is required and this lower pressure fluid requires a larger quantity of lean solution to absorb it. Thus, this approach to the solution of the problem of exergy losses arising from the high temperature of the fluid exiting the turbine is not desirable.

SUMMARY OF THE INVENTION

It is a primary object of one aspect of the present invention to provide a method and apparatus for increasing the efficiency of the Exergy cycle by enabling the selection of a low pressure and temperature basic solution at the turbine outlet through enrichment of the basic solution from the turbine prior to its regeneration by partial distillation.

It is a further object of the present invention to provide such a method and apparatus that lessens the heat loading on the condenser.

It is a primary object of another aspect of the present invention, to decrease the exergy losses arising from the superheating of the fluid exiting from the turbine without unduly lowering the pressure of the fluid.

It is another object of the present invention to provide a method and apparatus that efficiently regulates the temperature of the fluid exiting from a turbine in the Exergy cycle and uses any extra heat to obtain extra energy in the turbine.

These and other objects of the present invention may be achieved by a method of generating usable energy including the step of vaporizing at an upper intermediate pressure, only part of an initial multi-component working fluid stream having lower and higher temperature boiling components to form a first vapor fraction. The first vapor fraction is therefore enriched with the lower boiling temperature component. The vapor fraction is mixed with part of the initial working fluid stream and absorbed therein to produce a rich solution, enriched relatively to the initial working fluid stream with respect to the lower temperature boiling component. The remaining part of the initial working fluid stream is used as a lean solution which is impoverished relatively to the main solution with respect to the lower temperature boiling component. The pressure of the rich solution is increased to a charged high pressure level. The rich solution is evaporated to produce a charged gaseous main working fluid that is expanded to a spent low pressure level to transform its energy into usable form. The spent main working fluid is cooled and condensed by absorbing it in a part of the lean solution. An enriched fraction is separated from a part of the lean solution. The enriched fraction is enriched relatively to the lean solution with respect to the lower boiling temperature component. The enriched fraction is mixed with the condensed main working fluid to form an initial multi-component working fluid stream.

In accordance with another preferred embodiment of the present invention a method of generating usable energy includes the step of generating a vapor fraction by vaporizing only part of an initial multi-component working fluid stream having lower and higher temperature boiling components. The vapor fraction is enriched with the lower boiling temperature component. The vapor fraction is mixed with part of the initial working fluid stream and absorbed therein to produce a rich solution enriched relatively to the working fluid stream with respect to the lower temperature component. The remaining part of the initial working fluid stream is used as a lean solution impoverished relatively to the rich solution with respect to lower temperature boiling component. The pressure of the rich solution is increased to a charged high pressure level. The rich solution is evaporated to produce a charged, superheated gaseous main working fluid and expanded to a spent low pressure level to convert energy into a usable form. The spent main working fluid is cooled and condensed by dissolving it in a portion of the lean solution. A portion of the lean solution is also injected into the charged gaseous working fluid to lower the temperature of the gaseous working fluid. This injection may be made into the charged gaseous working fluid while the main working fluid is continuing to expand or it may be made into the gaseous main working fluid after the fluid has been completely expanded.

In accordance with still another preferred embodiment of the present invention an apparatus for generating usable energy with a multi-component working fluid includes a turbine with a gas inlet and a gas outlet. A distilling device is in fluid communication with the turbine gas outlet. This device is adapted to separate a lower boiling temperature component from a higher boiling temperature component of the multi-component working fluid using the heat of the outlet gas from the turbine. The distilling device includes a mixing section arranged to mix separated lower boiling temperature fraction with the working fluid to form a rich solution. A condenser is arranged to condense the rich solution and an evaporator communicates with the condenser and the inlet to the turbine. The injector is arranged to inject lean solution from the distilling device into the superheated fluid near the outlet of the turbine.

In accordance with yet another preferred embodiment of the present invention, an apparatus for generating usable energy with a multi-component working fluid includes a turbine having a gas inlet and a gas outlet and a condenser connected to condense the spent fluid from the turbine. A first distilling device is in fluid communication with the turbine gas outlet. This device is adapted to separate a lower boiling temperature component from a higher boiling temperature component and the multi-component working fluid. The distilling device includes a mixing section arranged to mix a separated lower boiling temperature fraction with the working fluid to form a rich solution. The second distilling device is arranged to separate a lower boiling temperature fraction from the fluid remaining after the lower boiling temperature component has been separated in the first distilling device. The second distilling device includes a mixer section adapted to mix a lower boiling temperature fraction separated by the second distilling device into the spent fluid from the condenser. An evaporator communicates with the condenser and the inlet to the turbine.

In accordance with another preferred embodiment of the present invention a regenerator for spent multi-component working fluid having a temperature and pressure too low for condensation by conventional means with an available cooling medium includes a first pump for increasing the pressure of the spent fluid. A concentrator increases the concentration of the lower boiling temperature component of the working fluid. A second pump increases the pressure of the concentrated fluid. A heat exchanger, communicating with the concentrator, is arranged to transfer heat from the unconcentrated spent fluid and to transfer heat to the concentrated spent fluid. A first separator communicates with the heat exchanger for separating a portion of the lower boiling temperature component from the concentrated fluid and for recombining the separated portion of the lower boiling temperature component with a portion of the remainder of the concentrated fluid so as to form a regenerated working fluid that may be condensed by the available cooling system. A second separator for extracting a lower boiling temperature component from a portion of the remainder of the concentrated fluid is arranged to supply lower boiling temperature component to the concentrator. The second separator may include a fluid pressure lowering device for extracting the lower boiling temperature component.

DESCRIPTION OF A PREFERRED EMBODIMENT

Figure 1:
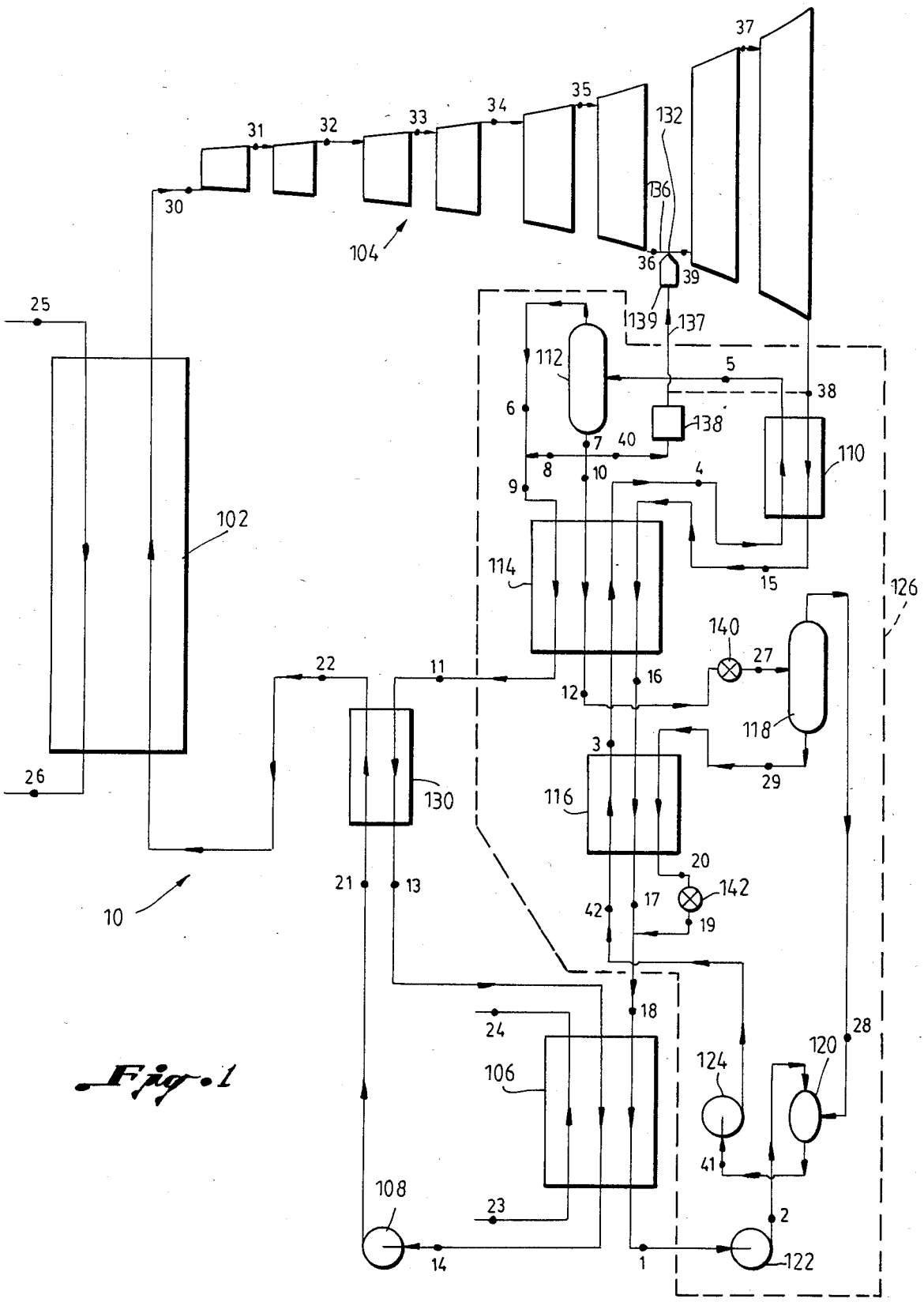
FIG. 1 is a schematic representation of one system for carrying out one embodiment of the method and apparatus of the present invention.

Referring to the drawing wherein like reference characters are utilized for like parts throughout the several views, a system 10, shown in FIG. 1, implements a thermodynamic cycle, in accordance with one embodiment of the present invention, using a boiler 102, a turbine 104, a condenser 106, a pump 108, and a distilling subsystem 126. The subsystem 126 includes a recuperator 110, a distilling gravity separator 112, a heater 114, a preheater 116, a deconcentrating separator 118, and a concentrator 120.

Various types of heat sources may be used to drive the cycle of this invention. Thus, for example, heat sources with temperatures as high as, say 500° C. or more, down to low heat sources such as those obtained from ocean thermal gradients may be utilized. Heat sources such as, for example, low grade primary fuel, waste heat, geothermal heat, solar heat or ocean thermal energy conversion systems may be implemented with the present invention.

A variety of working fluids may be used in conjunction with this system including any multi-component working fluid that comprises a lower boiling point fluid and a relatively higher boiling point fluid. Thus, for example, the working fluid may be an ammonia-water mixture, two or more hydrocarbons, two or more freons, mixtures of hydrocarbons and freons or the like. In general the fluid may be mixtures of any number of compounds with favorable thermodynamic characteristics and solubility. The system or cycle of this invention may be described by way of example by reference to the use of an ammonia-water working solution.

In an ammonia/water working solution, the ammonia constitutes the lower boiling component with a boiling point of −33° C., while water is the higher boiling component with a boiling point of 100° C. Then the higher the concentration of ammonia, the lower the boiling point of the water/ammonia composite.

The charged composite working fluid implements a continuous system wherein the fluid is expanded to convert energy into an usable form followed by continuous regeneration. A substantially constant and consistent quantity of the composite working fluid may therefore by maintained in the system for long term use.

The Exergy cycle utilized herein is generally described in pending U.S. patent application Ser. No. 405,942, filed on Aug. 6, 1982 in the name of the inventor of the present invention, and in ASME paper 84-GT-173 entitled "Combined Cycle System With Novel Bottoming Cycle" by A. I. Kalina. The pending application and ASME paper are hereby expressly incorporated herein by reference.

The basic spent working fluid in a condensed state, termed the distillation fluid herein, at point 1 has its pressure increased by the pump 122 to point 2 where the fluid exists as a subcooled liquid at a lower intermediate pressure, which is intermediate which respect to the pressure at the turbine inlet 30 and outlet 38. From point 2 the subcooled liquid is directed through the top of the concentrator 120 where it is mixed, for example by spraying, with the flow of saturated vapor having a higher concentration of the lower boiling point component arriving from point 28. The pressure at point 28 is made essentially the same as the pressure at point 2. Because of the increase in the pressure provided by the pump 122 the distillation fluid more easily absorbs the saturated vapor arriving from the point 28.

As a result of mixing in the concentrator 120, a saturated liquid passes outwardly from the concentrator 120 through the point 41. This saturated liquid has a higher concentration of the lower boiling component than the liquid existing at the point 2 so that the liquid at point 41 may be termed an "enriched" liquid. This enriched liquid is pumped by the pump 124 to an upper intermediate pressure at point 42. The liquid is then successively heated in preheater 116, heater 114, and recuperator 110. The heating processes in the preheater 116 and heater 114 are performed by recuperation of the heat of counterflowing outlet fluid from the turbine 104 as well as the heat from other fluids utilized in the system. However, the heating in the recuperator 110 is performed only by the heat of the flow from the turbine 104 outlet 38 and, as such, is compensation for under recuperation.

The enriched flow at point 5, for example, is partially evaporated and passes into the distilling gravity separator 112. Vapor, strongly enriched by the lower boiling point component is separated and passes through point 6. A lean stripped liquid, impoverished with respect to the lower boiling component which is substantially removed, exits from the separator 112 through point 7.

The lean liquid flow from the separator 112 is divided into three flow paths, identified by the points 8, 10, and 40. The flow of liquid passing through point 8 is proportionately mixed with the vapor from point 6. As a result, the generated mixture, passing point 9, has the necessary concentration of lower boiling and higher boiling components, to be used as the working fluid for the remainder of the cycle. The proportion of lower and higher boiling components forming the working fluid is selected to minimize the energy losses during operation. Generally, the fluid at point 9 is enriched with the lower boiling component with respect to the fluid at point 5.

In order to achieve the greatest possible efficiency it is also advantageous to choose the working composition concentration to get the minimum exergy losses in the boiler 102. As a practical matter, the applicable optimal range lies between 50 to 70 percent by weight of the low boiling component in most, but not necessarily all cases. Generally, it is advantageous to include at least 20 to 25% by weight of the higher boiling component.

This enriched working fluid is cooled in the heater 114, thereby providing the heat for the heating of the fluid passing from the point 3 to the point 4, as described above. In the boiler preheater 130, the flow is further cooled so that the fluid is completely condensed in the condenser 106, by cooling water flowing along the line 24 to 23.

The condensed working fluid is pumped by the pump 108 from the point 14 to the point 21 so that it moves counterflow through the preheater 116. The working fluid then flows through the boiler 102 where it is heated and preferably substantially evaporated. Most preferably the working fluid is completely evaporated, and superheated at point 30. The flow of boiler heating fluid is indicated by the line 25 to 26.

The superheated vapor is then expanded in the turbine 104 outputting the desired mechanical power. If the working fluid at point 38 is still superheated vapor, lean liquid from the distilling gravity separator 112 may be injected into the expanding working fluid in the turbine 104. This injection is most practical into the inlet to the last or the next to the last turbine stage. However, this result may also be accomplished by injection into fluid stream following exit from the turbine 104, for example at the point 38, as indicated in a dashed line in FIG. 1. As a result of this injection near the turbine outlet, the working fluid from the previous stage of the turbine 104 has its concentration changed in travelling from the point 36 to the point 39.

When the saturated liquid injection is accomplished before the last turbine stage it must be done in such proportions that the state of the working fluid in the following stage of the turbine 104 is still a superheated vapor. However, the temperature of the mixed gas at the point 39 is lower than the temperature of the gas in the turbine preceeding injection. Also, the concentration of the lower boiling point component at the point 39 is lower than the concentration at the point preceeding injection. The enthalpy at the point 39 is also lower than the enthalpy at the point preceding injection. Similarly the enthalpy, temperature and lower boiling component concentration at the outlet of the turbine 104 are lower than they would have been without injection. In addition, the weight flow rate at the turbine outlet is higher than at the point preceeding injection, since this flow rate is equal to the sum of the flow rates into the juncture 132.

The injection is most advantageously proportioned so that the outlet of the last stage of the turbine 104 has the characteristics of a saturated or wet vapor instead of superheated vapor. Alternatively, where injection is performed into the gas that has already exited from the turbine, the gas becomes a saturated vapor upon mixing with the injected fluid.

The pressure of the inlet fluid in the line 136 is made substantially equal to the pressure in the line 137 preceeding injection. To achieve this result, a pressure equalizing device 138 is utilized. The pressure equalizing device 138 may take the form of a throttle valve, when it is necessary to decrease the pressure of the incoming fluid to match that of the turbine. The device 138 may be totally omitted when the pressure of the inlet flow happens to equal that of the flow within the turbine 104. The pressure equalizing device 138 may take the form of a pump when it is necessary to increase the pressure in the line 136 to equal that in the line 137.

The turbine outlet flow passes from the point 38 consecutively through the recuperator 110, heater 114, and preheater 116 so that the flow is cooled and partially condensed. However, the pressure at the turbine outlet and consequently, at the recuperator 110 outlet, the heater 114 outlet, and the preheater 116 outlet may be so low that it may not be possible to condense the fluid at that pressure with the available cooling water temperature. While this result may appear to be unfortunate at first glance, in fact, this means that the energy of the fluid has been fully utilized in the turbine 104.

To overcome this problem, a portion of the stripped liquid flow removed from the distilling separator 112 is cooled in the heater 114 as it flows from the point 10 to the point 12. This process provides the heat necessary for the heating process of the fluid moving from point 3 to point 4. The stripped liquid flow is throttled by the throttle valve 140 to the lower intermediate pressure, at the point 27 (so that pressure at point 27 equals pressure at point 2). This fluid, at the lower intermediate pressure, is directed into the de-concentrating separator 118 where it is separated into two streams due to the lowering of the fluid pressure by the valve 140. The first stream is a saturated vapor which extends through the point 28, and is relatively enriched with respect to the lower boiling component. The second stream is an absorbing, lean solution passing through point 29, that is relatively impoverished with respect to the lower boiling component and therefore tends to readily absorb the low boiling component. The vapor passing through the point 28 is directed into the concentrator 120 where it is mixed with subcooled liquid flow from point 2 to increase the lower boiling component concentration of the fluid.

The absorbing lean solution passes the point 29 with the same pressure as the enriched flow at point 42 (upper intermediate pressure), but the lean solution has a much lower concentration of the lower boiling component than the flow at point 42. As a result, the temperature at the point 29 is always higher than the temperature at the point 42. Therefore the absorbing, lean flow at point 29 is sent through the preheater 116 where it is cooled, providing part of the heat necessary for heating the fluid flowing from the concentrator 120 through the preheater 116.

The cooled, absorbing, lean solution is throttled by the throttle valve 142 to a low pressure substantially equal to the pressure at the turbine outlet with parameters similar to those at the point 17. The turbine outlet flow at point 17 and the absorbing, lean solution flow at point 19 are mixed, generating a flow of a basic solution at point 18. The concentration of the higher boiling component in the flow at the point 18 is such that the fluid can be completely condensed at the available cooling water temperature. Therefore, this flow is fully condensed in the condenser 106 to reach the parameters of the fluid at point 1, after which the above-described process is repeated.

Those skilled in the art will appreciate that it is desirable in terms of thermal efficiency to have the highest possible fluid temperature at the inlet to the turbine. This is because it always beneficial to have the working fluid and the heating fluid at relatively close temperatures. By maximizing the temperature at the inlet to the turbine 104, a greater power output may be obtained from the turbine 104 with a consequently greater enthalpy drop than would be obtained if a lower temperature were utilized.

Nevertheless, the temperature at the turbine outlet must increase corresponding to the increased temperature at the turbine inlet. This may mean that the working fluid flow leaving the turbine 104 may still be in a superheated vapor state. However, this extra energy existing in the form of superheated vapor is essentially useless in the distillation process and is generally useless in the cycle as a whole. This means that there is an incomplete use of the energy potential of the working fluid.

To achieve the highest possible cycle efficiency, a relatively high concentration of the lower boiling point component in the working fluid passing through the boiler 102 and the turbine 104 is desirable. However, at the same time, it is preferable to have a lower concentration of the lower boiling component in the turbine output flow passing through the distillation subsystem 126.

Thus the injection of liquid into the turbine 104 through the injector 139, immediately reduces the lower boiling component concentration of the flow passing through the last stages of the turbine 104, causing thermodynamic losses. Those losses are compensated for by the higher weight flow rate of the flow through the last stages of the turbine 104. Absent this accommodation, the potential energy in the fluid flow through the turbine would be unused and would be essentially wasted in the heat exchange processes of the distillation subsystem 126.

It should be understood that the present cycle may be operable without the use of injection of liquids from the separator 112 into the turbine 104. Specifically if the fluid exiting from the outlet of the turbine 104 is not superheated, injection may be wasteful and is generally unnecessary.

When injection of liquid into the turbine 104 is appropriate, the point of injection is determined by the point where the smallest possible exergy losses result in the cycle. One of ordinary skill in the art will be capable of determining this point. It generally will lie somewhere in the latter stages of the turbine or after exit from the turbine.

Through the use of the liquid injection system, additional power may be gained from the turbine 104. This arises primarily from the higher flow rate through the turbine 104. However, it can be appreciated that the available energy is utilized in a more efficient manner to increase the output from the turbine 104.

The concentrator 120 and related components enable the concentration of the basic solution to be chosen to accommodate a relatively low pressure and temperature at the turbine outlet. Thus, even where the pressure and temperature at the turbine outlet are seemingly insufficient to enable distillation of the basic solution, the operation of the system is not adversely affected. This is because an enriched solution, having a significantly higher concentration of the lower boiling component, is the one that is subjected to the distillation process. For this enriched solution a lower turbine outlet temperature is sufficient to enable distillation to proceed on an efficient basis.

However, it should also be appreciated that this result is achieved while decreasing the heat loading on the condenser 106. This is because part of the hot liquid from the separator 112 is diverted to other processes, without condensation, and therefore less condensation is necessary. In other words, the fluid outletted from the turbine 104 is mixed, before condensation, with absorbing, lean flow which is even leaner than the liquid flow coming from the distilling separator 112. Therefore, after absorption, the leaner portion of the flow which is coming into the condenser 106 is in the form of liquid, and thus a lower quantity of heat has to be removed to produce condensation. This presumably lowers condenser surface requirements and increases the efficiency of the system.

Overall, with present invention using the injector 139, the average temperature of the fluid flow from the point 38 to the point 17 is effectively increased. At the same time the average temperature of the required heat from the point 42 to the point 5 is decreased by injecting the enriched vapor in the concentrator 120. Thus, separately and in combination, these effects serve to increase overall system efficiency.

Relatively lower temperature heat for the distillation subsystem 126 of this invention may be obtained in the form of spent relatively high temperature heat, the lower temperature part of relatively higher temperature heat from a heat source, the relatively lower temperature waste or other heat which is available from a heat source, and/or the relatively lower temperature heat that cannot be utilized efficiently for evaporation in the boiler. In practice, any available heat, particularly lower temperature heat which cannot be used effectively for evaporation, may be utilized as the relatively lower temperature heat for the distillation subsystem 126. In the same way such relatively lower temperature heat may be used for preheating.

While the present invention has been described with respect to a single preferred embodiment, those skilled in the art will appreciate a number of variations and modifications therefrom and it is intended within the appended claims to cover all such variations and modifications as come within the true spirit and scope of the present invention.

What is claimed is:

1. A method of generating usable energy comprising the steps of:

vaporizing, at an upper intermediate pressure, only part of an initial multi-component working fluid stream having lower and higher temperature boiling components to form a first vapor fraction, said first vapor fraction being enriched with said lower boiling temperature component;

mixing the first vapor fraction with part of the initial working fluid stream and absorbing it therein to produce a rich solution enriched relatively to the initial working fluid stream with respect to the lower temperature boiling component, and using a remaining part of the initial working fluid stream as a lean solution which is impoverished relatively to the rich solution with respect to the lower temperature boiling component;

increasing the pressure of the rich solution to a charged high pressure level and evaporating the rich solution to produce a charged gaseous main working fluid;

expanding the charged gaseous main working fluid to a spent low pressure level to transform its energy into usable form;

cooling and condensing the spent main working fluid by absorbing it in a lean solution at the spent low pressure level to form a distillation fluid;

increasing the pressure of the condensed fluid to a lower intermediate pressure;

forming from a part of said lean solution a second vapor fraction enriched with said lower boiling temperature component with respect to said condensed fluid;

mixing said second vapor fraction with said distillation fluid to form a mixture; and increasing the pressure of said mixture to said upper intermediate pressure to form said initial multicomponent working fluid stream.

2. The method of claim 1 including the step of separating a portion of said lean solution into said second vapor fraction and a second lean solution.

3. The method of claim 2 wherein the cooling step includes the step of absorbing said spent main working fluid in said second lean solution.

4. The method of claim 2 including the step of lowering the pressure of a part of the lean solution to separate said second lean solution and said second vapor fraction from said lean solution.

5. The method of claim 1 including the step of obtaining a substantial percentage of the higher boiling temperature component in the rich solution prior to evaporation.

6. The method of claim 5 wherein said rich solution includes at least about 20% by weight of higher temperature boiling component.

7. The method of claim 1 including the step of injecting a portion of said lean solution into said gaseous main working fluid when said gaseous main working fluid is superheated to reduce its temperature.

8. The method of claim 7 wherein said lean solution is injected until the expanded spent main working fluid becomes a saturated vapor.

9. A method of generating usable energy comprising the steps of:

generating a vapor fraction by vaporizing only part of an initial multi-component working fluid stream having lower and higher temperature boiling components, said vapor fraction being enriched with said lower boiling temperature component;

mixing the vapor fraction with part of the initial working fluid stream and absorbing it therein to produce a rich solution enriched relatively to the working fluid stream with respect to the lower temperature boiling component, and using a remaining part of the initial working fluid stream as a lean solution impoverished relatively to the rich solution with respect to the lower temperature boiling component;

increasing the pressure of the rich solution to a charged high pressure level and evaporating the rich solution to produce a charged, superheated gaseous main working fluid;

expanding the charged gaseous main working fluid to a spent low pressure level to convert energy into a usable form;

cooling and condensing the spent main working fluid by dissolving it in a portion of the lean solution; and injecting a portion of the lean solution into said charged gaseous working fluid after at least partial expansion to lower the temperature of said superheated gaseous working fluid.

10. The method of claim 9 including the step of injecting said portion of said lean solution into said charged gaseous main working fluid while said main working fluid is continuing to expand.

11. The method of claim 9, including the step of injecting the lean solution into said gaseous main working fluid after said gaseous main working fluid has been completely expanded.

12. The method of claim 9 including the step of equalizing the pressure of said injected portion of said lean solution with the pressure of the fluid into which said lean solution is injected.

13. The method of claim 9 wherein said lean solution is injected in such manner that said spent working fluid is a saturated vapor after injection of said lean solution and complete expansion.

14. An apparatus for generating usable energy using a multi-component working fluid comprising:

a turbine having a gas inlet and a gas outlet;

a distilling device in fluid communication with said turbine gas outlet, said device adapted to separate a lower boiling temperature component from a higher boiling temperature component of the multi-component working fluid, using the heat of the outlet gas from said turbine, said distilling device including a mixing section arranged to mix the separated lower boiling temperature fraction with the working fluid to form a rich solution;

a condenser arranged to condense said rich solution;

an evaporator communicating with said condenser and said inlet to said turbine; and an injector arranged to inject lean solution from said distilling device into the superheated fluid after at least partial expansion in said turbine.

15. The apparatus of claim 14 including an apparatus for equalizing the pressure of the fluid streams mixed by said injector.

16. The apparatus of claim 14 wherein said injector is adapted so that the gas at the outlet of the turbine is a saturated vapor.

17. An apparatus for generating usable energy using a multi-component working fluid comprising:

a turbine having a gas inlet and a gas outlet;

a condenser connected to condense the spent fluid from said turbine;

a first distilling device in fluid communication with said turbine gas outlet, said device adapted to separate a lower boiling temperature component from a higher boiling temperature component of the multi-component working fluid, said distilling device including a mixing section arranged to mix the separated lower boiling temperature fraction with the working fluid to form a rich solution;

a second distilling device arranged to separate a lower boiling temperature fraction from the fluid remaining after said lower boiling temperature component has been separated in said first distilling device, said second distilling device including a mixer section adapted to mix the lower boiling temperature fraction separated by said second distilling device into the spent fluid from said condenser; and an evaporator communicating with said condenser and said inlet to said turbine.

18. The apparatus of claim 17 wherein said second distilling device includes means for lowering the pressure of said fluid from said first distilling device to facilitates separation of said lower boiling temperature component in said second distilling device.

19. The apparatus of claim 18 wherein said second distilling device includes means for returning the higher boiling temperature fraction remaining after separation of said lower boiling temperature component to working fluid stream.

20. The apparatus of claim 19 wherein said returning means includes a heat exchanger arranged to permit said fluid to transfer heat to said working fluid, and further includes pressure lowering means for decreasing the pressure of said fluid before mixing it with said working fluid.

21. The apparatus of claim 17 including an injector arranged to inject lean solution from said first distilling device into superheated fluid near the outlet of said turbine.

22. A regenerator for spent multi-component working fluid, having a temperature and pressure too low for condensation by conventional means with an available cooling medium, said regenerator comprising:

a first pump for increasing the pressure of said spent fluid;

a concentrator for increasing the concentration of the lower boiling temperature component of said working fluid;

a second pump for increasing the pressure of said concentrated fluid;

a heat exchanger, communicating with said concentrator, arranged to transfer heat from said unconcentrated spent fluid and to transfer heat to said concentrated spent fluid;

a first separator communicating with said heat exchanger for separating a portion of the lower boiling temperature component from said concentrated fluid and for recombining said separated portion of the lower boiling temperature component with a portion of the remainder of said concentrated fluid so as to form a regenerated working fluid that may be condensed by the available cooling medium; and a second separator for extracting a lower boiling temperature component from a portion of said remainder of said concentrated fluid, said second separator arranged to supply lower boiling temperature component to said concentrator.

23. The regenerator of claim 22 wherein said second separator includes a fluid pressure lowering device for extracting the lower boiling temperature component.

* * * * *